United States Patent [19]

Brom

[11] Patent Number: 4,756,699

[45] Date of Patent: Jul. 12, 1988

[54] FOREARM SWIM FIN

[76] Inventor: Stephen A. Brom, 824 Rose Ave., Venice, Calif. 90291

[21] Appl. No.: 874,562

[22] Filed: Jun. 16, 1986

[51] Int. Cl.[4] ..... A63B 31/12

[52] U.S. Cl. ..... 441/59

[58] Field of Search ..... 441/55, 56, 59, 60; D21/237–239

[56] References Cited

U.S. PATENT DOCUMENTS

| | | | |
|---|---|---|---|
| 689,085 | 12/1901 | Hooper | 441/59 |
| 1,548,054 | 8/1925 | Meadows | 441/59 |
| 3,097,375 | 7/1963 | Griffith | 441/59 |
| 3,107,371 | 10/1963 | Thompson | 441/59 |
| 3,290,707 | 12/1966 | Montgomery | 441/59 |
| 3,424,133 | 1/1969 | Brady | 441/60 |
| 3,827,095 | 8/1974 | Feather | 441/59 |

FOREIGN PATENT DOCUMENTS

| | | | |
|---|---|---|---|
| 423782 | 1/1926 | Fed. Rep. of Germany | 441/60 |

*Primary Examiner*—Joseph F. Peters, Jr.
*Assistant Examiner*—Stephen P. Avila
*Attorney, Agent, or Firm*—Francis X. LoJacono

[57] ABSTRACT

A swimming aid includes a pair of curved molded plastic armbraces together with a pair of removeable straps for securing the curved armbraces to the forearm of a swimmer. A pair of substantially planar fin members are pivotally attached to the armbraces by means of a hinge combination which includes pivot limits to restrict the pivotal motion of the fin members between an outwardly extending position and a rearwardly extending collapsed position. Stop members are provided for altering the collapsed position of the fin members to increase the effort required of the swimmer during the return stroke.

11 Claims, 2 Drawing Sheets

FIG. 1
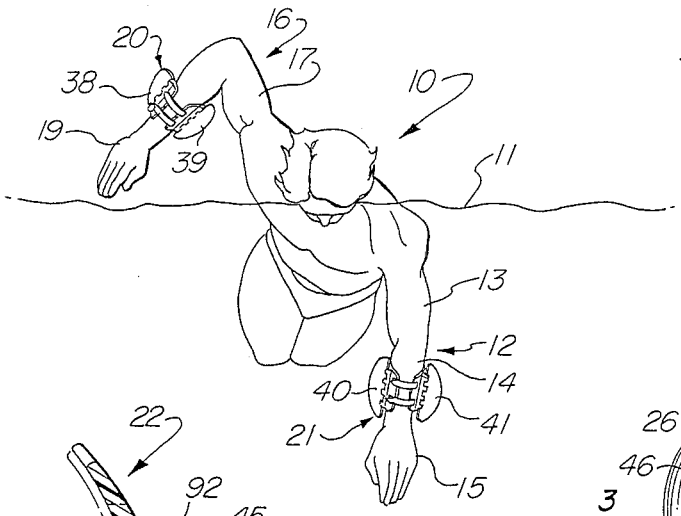
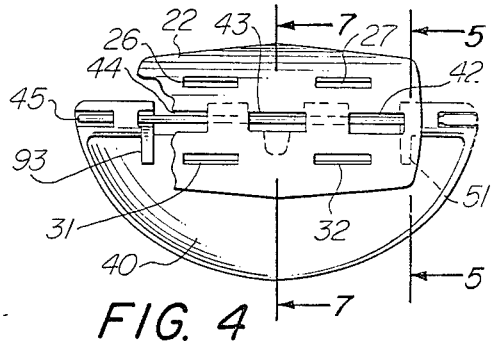
FIG. 4
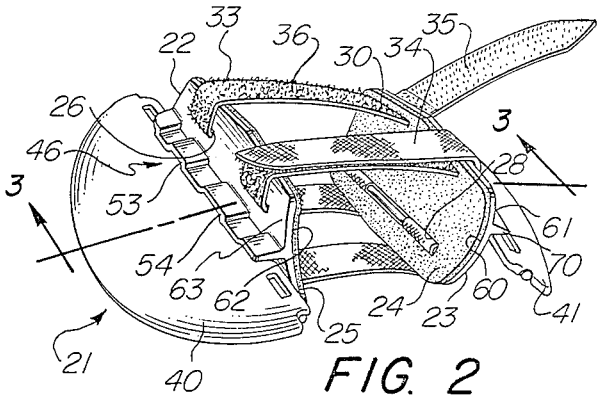
FIG. 2
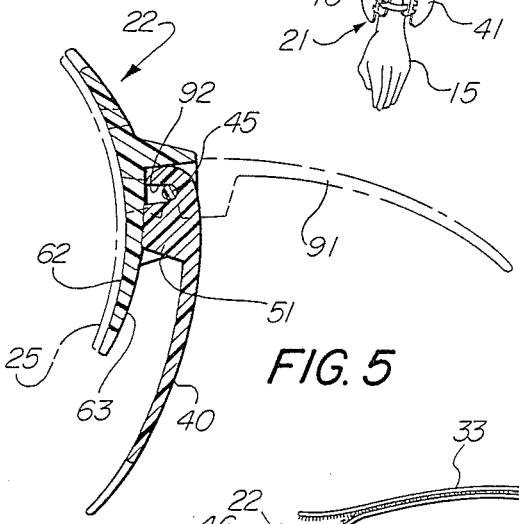
FIG. 5
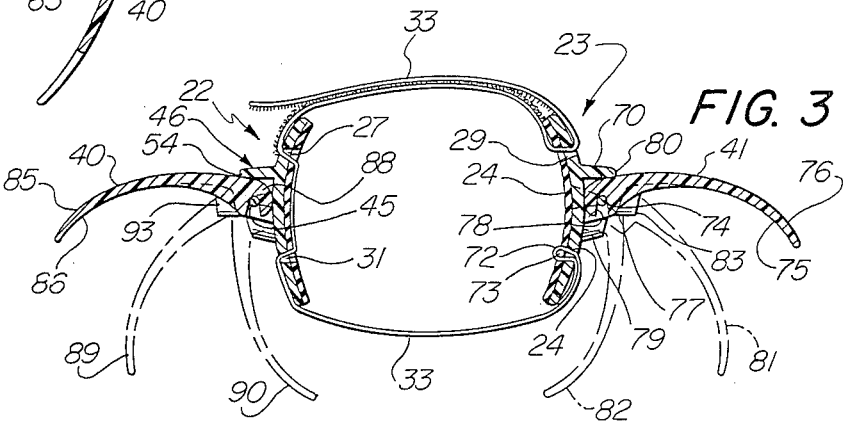
FIG. 3
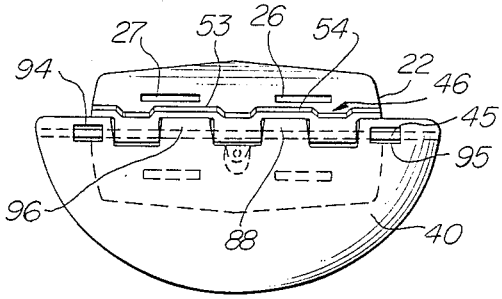
FIG. 6

FIG. 7
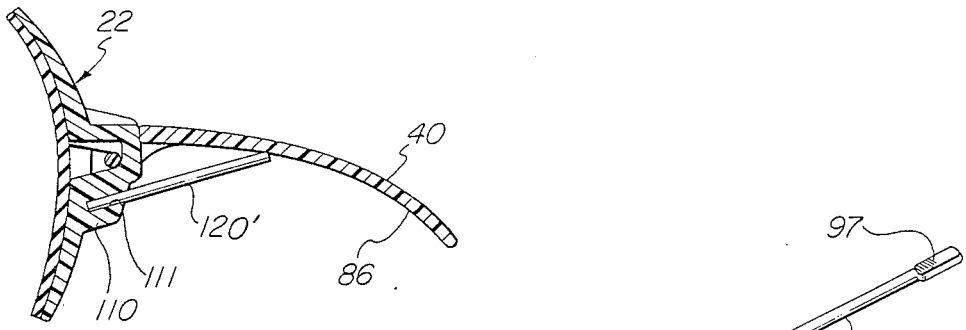
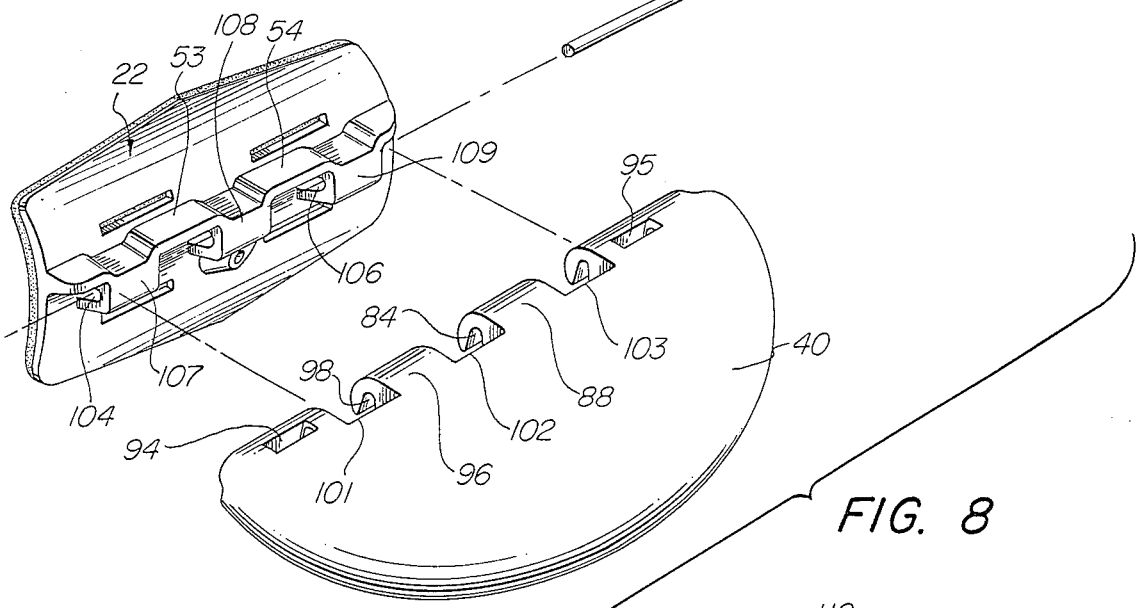
FIG. 8
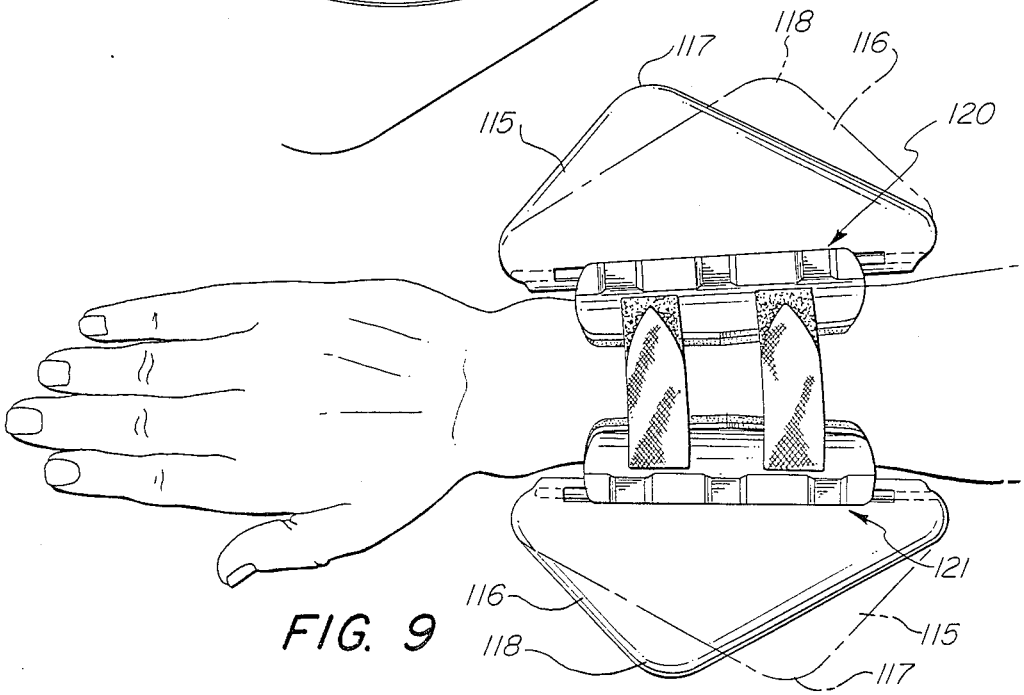
FIG. 9

FOREARM SWIM FIN

FIELD OF THE INVENTION

This invention relates generally to swimming aids and particularly to those secured to the forearm of a swimmer.

BACKGROUND OF THE INVENTION

A number of swimming strokes have evolved through the years by which humans are able to swim at or near the surface of the water and below the surface as well. Common surface swimming strokes include the crawl stroke as well as the breast stroke, back stroke and side stroke. Underwater swimming generally utilizes a stroke similar to the breast stroke. In addition, surfers propelling their surfboards through the water typically assume a kneeling position on the surfboard and propel themselves forward by bending forward and extending their arms on either side of the surfboard into the water and drawing themselves forward. While the particular characteristics of these strokes may vary, a common factor exists in that both swimmers and surfers use repeated motion in which one or both of the arms are extended forward in a reaching motion into the water at a point ahead of the swimmer or surfer's body followed by a drawing or pulling motion known as the power stroke. During the power, the hands and forearm are pulled back against the resistance of the water and until the arms are extended backwardly. At the conclusion of the power stroke, the return stroke is commenced and the arms are moved out of the water, usually raised being moved through the air above the water, and reached forward and back into the water to start the next power stroke.

As a result, despite the differences between the types of strokes employed and their timing and the details of stroke motion which are, to a large extent, varied as a matter of swimmer's style and selected stroke, virtually all swimming strokes, as well as the above-described surfer's paddling motion, may be increased in effectiveness by increasing the resistance to the movement of the arm through the water during the power stroke. This increased resistance permits the swimmer to impart greater energy to the water. Conversely, the desire is the opposite in the return stroke, namely to move the arm through the air and to the extent necessary, through the water with a minimum of resistance and lost energy.

Through various techniques, swimmers and surfers have employed certain changes during power and return strokes whereby he configurations and positions of the hands are used to provide a measure of this variable resistance to arm motion through the water. This duality of arm motion resistance is critical to the efficiency of the swimmer during the swimming process as well as the surfer during the paddling process. In essence, the difference between the force that a swimmer or surfer can generate in a forward direction during the power stroke and the resistance resulting from the swimmer's drawing the arm back from the end of a power stroke and repositioning it to commence another power stroke is the limit on a swimmer's efficiency.

In order to further enhance the capabilities of swimmers and surfers to stroking efficiency, there have been designed and created various swimming aid devices which generally comprise some type of fin or pair of fins attached to the swimmer's forearm. As will be seen in the discussion below, it is common to all such devices that a dual character is required in the power stroke and the return stroke. Typically, this duality is accommodated in some manner by which the surface area or contour of the device is altered in response to arm motion through the water.

The common factor in such swimming aids may be further generalized in that there is the provision of a greater effective surface area during the power stroke than during the return stroke.

One of the simpliest forms of swimming aids uses a substantially planar paddle-like structure attached to the hand and forearm of the swimmer which relies upon the swimmer's hand and wrist action to change the pitch of the paddle in the same fashion that a swimmer changes the pitch of his or her hand during normal swimming strokes. Such paddle devices however, have proved to be substantially inefficient and this inefficiency has caused practitioners in the art to create other swimming aids for use on a swimmer's forearm. Most such devices use pairs of fins which are pivotally arranged on the swimmer's arm and attached in such a manner that the swimmer's stroke motion causes the fins to move outwardly from the swimmer's forearm to increase effective area during the power stroke, and to move inwardly to a more collapsed position against the swimmer's forearm during the return stroke.

For example, U.S. Pat. No. 3,290,707 for a Swimming Aid filed in the name of Maxson H. Montgomery, sets forth a swimming aid in which a pair of plates are arranged side by side and attached to a resiliant band encircling the swimmer's arm such that the top of the band is disposed on the front side of the swimmer's arm. Resiliant attachment means secure the plates to the band and through their resiliance bias the plates toward a collapsed position against the swimmer's arm. During the power stroke, the resiliance of the attachment means is overcome by the force of the water against the underside of the plates causing them to pivot outwardly. During the return stroke, the opposite effect takes place in that the withdrawing motion of the return stroke causes the water flow over the top of the plates which together with the resiliant bias of the attachment means returns the plates to a collapsed position.

Another example is found in U.S. Pat. No. 3,827,095 for a Swim Fin filed by Alec Feather which sets forth a swim fin having a support strap attachable to the forearm of a swimmer in which the lower portion of the strap encircles the swimmer's forearm. A pair of laterally spaced fin members depend from the lower portion of the strap and extend outwardly from each other. As in the case of the above-described U.S. Pat. No. 3,290,707, the structure in U.S. Pat. No. 3,827,095 provides for motion of the forearm swim fins outwardly during the power stroke and inwardly during the return stroke. In addition, the device in U.S. Pat. No. 3,827,095 provides resiliant restraining means which are attached to the fin members so as to provide restraint of outward fin motion proportional to the force applied thereby producing resistance to the water during the power stroke in proportion to the applied force by the swimmer. The thrust of U.S. Pat. No. 3,827,095 is to provide fin members having positions adjusted automatically in response to variations in the force applied by the swimmer thereby accommodating the individual swimmer's strength. Still another example is found in U.S. Pat. No. 3,107,371 issued to Thomas E. Thompson which sets forth a swimming device having a generally tubular cuff-like member configured to be worn upon the forearm of the swimmer. A generally planar member is attached to the underside portion of the tubular member and extends outwardly therefrom and terminates in a pair of opposed fin members. The fin members are pivotally attached near the underside of the tubular member such that they are moveable between outwardly extended positions for the power stroke and downwardly extending positions during the return stroke. The function of the device set forth in U.S. Pat. No. 3,107,371 is directed to fulfilling substantially the same purpose as the above-described devices with the difference that the fin members are supported on the underside of the swimmer's forearm rather than on the upper surface. By way of further difference, provision is made in the device in U.S. Pat. No. 3,107,371 whereby the pivotal fin members assume different positions during the return stroke depending upon whether the return stroke is passing through the water or through the air. U.S. Pat. No. 3,097,375 issued to John D. Griffith, sets forth a forearm supported swimming aid having a pair of pivotally supported fins attached to the top portion above the outer surface of the swimmer's forearm. The device in U.S. Pat. No. 3,097,375 is similar in function to the above-described devices and further includes an additional support sling which encircles the little finger and thumb of the swimmer and is attached to the forearm support. The purpose of the hand sling is to inhibit rotation of the fin device during swimming strokes.

While the foregoing devices provide some improvement in the energy that a swimmer may apply to the water during the power stroke and do adjust to reconfigure during the return stroke, the prior art devices thus far have been subject to several limitations. In the devices provided thus far, the fins are not readily changed to accommodate different swimming conditions, different swimmers or different strokes. In addition, the hinge mechanisms utilized in the devices provided in the art thus far are somewhat imprecise and inconsistant in their control of the fin attitudes during the swimming strokes. Further, the prior art devices have not provided a swimming aid which includes the capability to precisely control the change in fin characteristic at the swimmer's choice during the return stroke in order to utilize the increased resistance as a means of building swimmer's strength.

SUMMARY OF THE INVENTION

Accordingly, it is an object of the present invention to provide an improved swimming aid for attachment to a swimmer's forearm. It is a further object of the present invention to provide an improved swimming aid which is attached to the swimmer's forearm and which more precisely controls the surface area configuration provided by the swimming aid during the power and return strokes. It is a still further object of the present invention to provide an improved swimming aid having interchangeable fin members operable without removal of the device from the swimmer's forearm. It is a still further object of the present invention to provide an improved swimming aid capable of being configured to provide a controlled increase in fin surface area during the return stroke with the purpose of increasing swimmer's strength development.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 is a pictorial view of a swimmer exercising the crawl stroke and utilizing a pair of forearm swim fins constructed in accordance with the present invention;

FIG. 2 is a perspective view of a forearm swim fin constructed in accordance with the present invention;

FIG. 3 is a section view of a forearm swim fin constructed in accordance with the present invention and taken along section lines 3—3 in FIG. 2;

FIG. 4 is a side view of a portion of the forearm swim fin constructed in accordance with the present invention;

FIG. 5 is a section view of the portion of the present invention forearm swim fin taken along section lines 5—5 in FIG. 4;

FIG. 6 is a side view of the outside of the portion of the present invention swim fin shown in FIG. 4;

FIG. 7 is a section view of the present invention swim fin adjusted to provide increased return stroke resistance;

FIG. 8 is an exploded view of the hinge and fin assembly of the arm swim fin; and FIG. 9 is a top view of an alternate embodiment of the present invention forearm swim fin shown worn by a swimmer in which a dashed line representation depicts the alternate fin orientation achieved by interchanging fin members.

DESCRIPTION OF THE PREFERRED EMBODIMENTS

FIG. 1 shows a perspective view of a swimmer 10 exercising a crawl stroke near a water surface 11. In the position show, swimmer 10 has a left arm 12 positioned beneath water surface 11 such that upper arm 13, forearm 14 and left hand 15 of swimmer 10 are extended forward at the initiation of a power stroke. A forearm swim fin 21 constructed in accordance with the present invention and described in detail below, is attached to forearm 14 of swimmer 10. In accordance with an important aspect of the present invention, fins 40 and 41 of forearm swim fin 21 are shown in their outwardly pivoted or extended position in accordance with which swimmer 10 may exert an increased force upon the water. In the position shown and in accordance with the crawl stroke characteristic, swimmer 10 also has a right arm 16 which is moving in a return stroke and in accordance with which upper arm 17 is pointed upward from water surface 11 while forearm 18 and right hand 19 extend downwardly from upper arm 17 toward water surface 11. Swimmer 10 has a forearm swim fin 20 identical in construction to forearm swim fin 21 and constructed in accordance with the present invention. Fins 38 and 39 if forearm swim fin 20 are shown in a relaxed position, the details of which will be described below in greater detail.

FIG. 2 is a perspective view of forearm swim fin 21 constructed in accordance with the present invention and having a pair of fins 40 and 41 shown in their fully extended positions depicted in FIG. 1. Forearm swim fin 21 includes a pair of arm braces 22 and 23 which are of identical construction. Armbrace 22 is preferably formed of a molded lightweight material such as plastic and defines a concave surface 62 and a convex surface 63. The general curvatures of concave surface 62 and convex surface 63 are selected to conform to the curvature of the forearm portion of swimmer 10. An elongated hinge rib 46 extends outwardly from convex surface 63 and defines a pair of hinge stops 53 and 54. The details of hinge stops 53 and 54 are set forth below in greater detail. However, suffice is to note here that in accordance with an important aspect of the invention, the upper surface of swim fin 40 contacts or abutts hinge stops 53 and 54 when fin 40 is fully extended. Armbrace 22 further defines a plurality of elongated slots 26, 27, 31 and 32 (slots 31 and 32 better seen in FIG. 4). A pad 25 is bonded to concave surface 62 and is formed of a suitable cushioning material. Pad 25 enhances the gripping action of concave surface 62 upon forearm 14 of swimmer 10 and provides a cushioning affect when forearm swim fin 21 is attached to forearm 14. Alternatively, pad 25 may be eliminated by molding concave surface so as to provide a molded non-slip surface.

As mentioned, armbrace 23 is constructed in identical fashion to armbrace 22 and defines a concave surface 60 and a convex surface 61, the curvatures of which are selected to conform to the forearm 14 of swimmer 10. A pad 24 identical in construction to pad 25 is bonded to concave surface 60. Armbrace 23 defines a quartet of elongated slots 28, 29, 30 and 37. Fin 41, which is identical in construction to fin 40 is, by means of a hinge described below in greater detail, pivotally attached to armbrace 23 and shown in its fully extended position. Armbrace 23 further defines an outwardly extending hinge rib 70 which is identical to hinge rib 46 of armbrace 22. A strap 33 formed of an elongated fabric member is attached at one end up to armbrace 23 at slot 37 by means described below in greater detail and wraps around a portion of convex surface 61 and spans the spacing between armbraces 22 and 23. Strap 33 passes through slot 32 from convex surface 63 through slot 32 and upwardly across pad 25 and back outwardly through slot 26. Strap 33 then extends across the remaining portion of convex surface 63 across the space between armbraces 22 and 23 to enter slot 30 of armbrace 23 from concave surface 60 and extend beyond. Strap 33 is shown in the open or unstrapped position which it would assume when forearm swim fin 21 is being either removed from or attached to forearm 14 of swimmer 10. A plurality of velcro hooks 35 are supported on the under surface of the portion of strap 33 extending beyond slot 30 and a cooperating velcro pad 36 is supported upon the outer surface of strap 33 in the region which spands the space between armbraces 22 and 23. In normal use, forearm swim fin 21 is placed upon forearm 14 of swimmer 10 and strap 33 is drawn with sufficient force to tighten forearm swim fin 21 against forearm 14 and ensure that pads 24 and 25 are forced tightly against and grip the surface of forearm 14. Thereupon, the extending portion of strap 33 bearing velcro hooks 35 is drawn across the spand between armbraces 22 and 23 and velcro hooks 35 are forced into velcro pad 36 to secure the strap attachment. A similar operation is carried forward on a second strap 34 which is identical in construction to strap 33. Strap 33 is a depicted in its closed position and, by means set forth below in greater detail, is attached at one end to armbrace 23 within slot 28 and extends across convex surface 61 and spans the space between armbraces 22 and 23 and enters lots 31 of armbrace 22 from convex surface 63. Strap 34 then travels upwardly across pad 25 and passes outwardly through slot 27 of armbrace 22 and in similar fashion to strap 33 traverses a portion of convex surface 63 and the span between armbraces 22 and 23 enters slot 29 from concave surface 60. The remaining portion of strap 34 is, in similar fashion to strap 33, supportive of a plurality of velcro hooks (not shown) and a velcro pad (also not shown) similar to velcro pad 36 of strap 33.

FIG. 3 shows a section view of forearm swim fin 21 taken along section lines 3—3 in FIG. 2. Armbraces 22 and 23 are shown in the spaced apart and opposed positions which they assume when worn by the swimmer with their concave surfaces inwardly facing. Strap 34 defines a loop 72 at one end which extends through slot 24 in armbrace 23. As is better seen in FIG. 2, strap 33 defines a loop 59 identical to loop 72 of strap 34 which extends through slot 37 in armbrace 23. A strap pin 73, preferrably formed of a molded plastic material, extends through loop 72 in strap 34 and loop 59 in strap 33 and across the space between slots 37 and 28 in armbrace 23. The loop ends of straps 33 and 34 are secured and held in place by the combined drawing forces of straps 33 and 34 and the portion of pin 73 which spans the portion of concaves surface 60 of armbrace 23 between slots 37 and 28. Fin 41 is shown in its fully extended position which it assumes during the power stroke. Fin 41 defines a general curvature having a convex upper surface 76 and a concave under surface 75.

Fin 41 further defines a hinge tab 77, the construction of which is seen better in FIG. 8, which in turn defines a pin slot 78. In accordance with means shown in greater detail below, a hinge pin 74 extends through hinge tab 77 at pin slot 78 and forms the pivot about which fin 41 is moveable between its fully extended position shown in FIG. 3 and the feathered or collapsed positions depicted in dash line fashion 81 and 82. It should be understood that dash line representations 81 and 82 depict representative positions of fin 41. However, the motion of fin 41 as it pivots about hinge pin 74 is continuous and is controlled, by means set forth below in greater detail, by the flow of water relative to and across forearm swim fin 21. Hinge rib 70 in turn defines a plurality of hinge stops including hinge stop 80. As mentioned, hinge rib 70 is identical in construction to hinge rib 46 shown in FIG. 2 of armbrace 22. In accordance with an important aspect of the present invention, the extreme extension of fin 41 shown in FIG. 3 is limited from further travel by the abuttment of hinge stop 80 as well as the remaining hinge stops (not visible) of hinge rib 70 such that further extension or clockwise pivoting of fin 41 is precluded.

As mentioned, armbrace 22 is identical to armbrace 23 and defines an outwardly extending hinge rib 46 which in turn defines a plurality of hinge stops including hinge stop 54. Fin 40 is identical in construction to fin 41 and defines a curved structure having a convex upper surface 85 and a concave under surface 86. Fin 40 further defines a hinge tab 88 which in turn defines a pin slot 84. A hinge pin 45 extends through pin slot 84 and forms the pivot about which fin 40 is moveable between its fully extended position shown in cross-section and its intermediate and collapsed positions shown in dashed line representations 89 and 90. The extension of fin 40 during the swimmer's power stroke is limited in accordance with an important aspect of the present invention by the abuttment of hinge stop 54 against the underlying portion of upper surface 85 of fin 40, fins 40 and 41 define tabs 87 and 83 respectfully which extend from hinge tabs 88 and 77 respectively. The functions of hinge stops 83 and 93 will be described below in greater detail. However, suffice it to state here that hinge stops 83 and 93 together with hinge stops 51 and 50 (not shown in FIG. 3) function to limit the travel of fins 40 and 41 in the collapsing direction and in accordance with an important aspect of the present invention, the maximum collapsed position shown by dashed line representations 82 and 90 maintains a predetermined spacing between the underlying surface of the swimmer's forearms and under surfaces 86 and 75 of fins 40 and 41 respectively.

The use of limited pivoting in the direction of collapsed travel of fins 40 and 41 provided by the abuttment of hinge stops 50, 51, 83 and 93 against the underlying portions of convex surfaces 61 and 63 of armbraces 23 and 22 provides an important advantage of the present invention in which the space maintained between the underside of fins 40 and 41 and the surface of the swimmer's forearms permit the flow of water during a power stroke to product a water pressure and an outwardly expanding force between the undersides of fins 40 and 41 and the surface of the swimmer's forearm which in turn causes a force which ensures the pivoting of fins 40 and 41 from collapsed positions 90 and 82 respectively to the intermediate positions 89 and 81 respectively and eventually to the fully extended positions shown in FIG. 3. This aspect of the present invention overcomes a serious defect in the operation of many of the prior art swimming aids in that the absence of such a spacing can cause the forces of the swimmer's power stroke to drive the fins against the swimmer's forearms rather than outwardly to the extended position required during the power stroke.

FIG. 5 shows a section view of armbrace 22 and fin 40 taken along the section lines 5—5 in FIG. 4. For purposes of description fin 40 is shown in FIG. 5 both in dashed line representation at the extended position and full section depiction in the fully collapsed position. A hinge stop 51, similar to hinge stop 93 on fin 40, extends away from pin slot 92 and in the collapsed position abutts convex surface 63 of armbrace 22. As can be seen with reference to FIGS. 5 and 3 together, the curvature of fin 40 and 41 is advantageous in maximizing the efficiency of operation of the present invention forearm swim fin during the power stroke. It will be equally apparent to those skilled in the art that the same curvature is advantageous in causing the pivoting motion of fins 40 and 41 when the arm motion of the swimmer reverses and the water passing the forearm swim fin is operative to pivot fins 40 and 41 away from the fully extended position. With fins 40 and 41 in the collapsed positions shown in FIG. 3 by dashed line depictions 82 and 90, the curvature of fins 40 and 41 maximizes the efficiency with which the forearm swim fin of the present invention may be moved through the water during the return stroke. But for the spacing maintained however, between the under surfaces of fins 40 and 41 and the surface of the swimmer's forearm, the initiation of a power stroke by the swimmer would, due to the curvature of fins 40 and 41, result in driving fins 40 and 41 more firmly against the surface of the swimmer's forearm which of course is the opposite to the effect desired.

Stated another way, it is advantageous to provide the curvature of fins 40 and 41. However, that curvature of itself without the important aspect of the present invention provided by hinge stops 51 and 93 on fin 40 and hinge stops 50 and 83 on fin 41 would result in the foregoing described inability or unreliability of fin extension during the power stroke. Accordingly, and in accordance with an important aspect of the present invention, the travel of fins 40 and 41 has been limited both in the extension direction and in the collapsed direction permitting the use of the more efficient and desirable curved fin structure.

FIG. 6 shows the assembly of armbrace 22, hinge pin 45 and fin 40 of FIG. 4 viewed from the opposite side in which fin 40 extends downward in the collapsed position shown in FIG. 5. As described above, hinge rib 46, which extends outwardly from armbrace 22, defines a pair of hinge stops 53 and 54. Fin 40 defines a pair of hinge tabs 88 and 96 which extend beneath hinge stops 54 and 53 respectively and which receive hinge pin 45. The latter extends transversely through the entire length of the hinge assembly (shown in exploded view in FIG. 8) securing fin 40 to armbrace 22. It should be noted that in the position shown in FIG. 6 with fin 40 in its collapsed position, hinge tabs 88 and 96 do not abutt hinge stops 54 and 53 respectively. This permits fin 40 to move freely between the fully extended and collapsed positions shown in FIG. 3. Fin 40 further defines a recess 95 and a recess 94 which comprise an additional hinge support which is described below in greater detail.

FIG. 8 shows an exploded or assembly view of the combination of armbrace 22, hinge pin 45 and fin 40. As mentioned, hinge rib 46 extends from armbrace 22 and defines a pair of spaced apart hinge stops 53 and 54. The positions of hinge stops 53 and 54 are spaced to overlie hinge tabs 96 and 88 respectively on fin 40. Hinge rib 46 further defines a trio of hinge extensions 107, 108 and 109. Hinge extension 108 is positioned between hinge stops 53 and 54 while hinge extensions 107 and 109 are spaced on either side of hinge stops 53 and 54. Hinge extensions 107, 108 and 109 define channels 104, 105 and 106 respectively which each extend transversely through their respective hinge extensions and are in axial alignment such that hinge pin 45 may be passed through channels 104, 105 and 106.

Fin 40 defines a pair of hinge tabs 96 and 88 and a trio of spaces 101, 102 in 103 therebetween. Hinge tabs 96 and 88 are spaced apart and sized such that hinge tab 96 fits between hinge extensions 107 and 108 and hinge tab 88 fits between hinge extension 108 and 109 with sufficient clearance that fin 40, when assembled to armbrace 22, is free to pivot about hinge pint 45. Clearance spaces 101, 102 and 103 receive hinge extensions 107, 108 and 109 respectively when fin 40 is assembled to armbrace 22 by inserting hinge tabs 96 and 88 beneath hinge stops 53 and 54 respectively. Hinge tabs 96 and 88 define downwardly facing pin slots 98 and 84 respectively which extend transversely across the hinge tabs. Fin 40 further defines a recess 94 comprising a curved surface extending downwardly from the upper surface of fin 40 to form a channel across which hinge pin 45 passes during assembly and which aids in retaining fin 40 in pivotal attachment to armature armbrace 22. A similar recess 95 is positioned at the opposite end of fin 40 from recess 94 and extends downwardly from the upper surface of fin 40 to provide a similar channel across which hinge pin 45 passes when fin 40 is assembled to armbrace 22. The channels formed by recesses 94 and 95 as well as pin slots 98 and 84 are aligned along a common axis. Fin 40 is assembled to armbrace 22 by positioning it with respect to armbrace 22 such that hinge tabs 96 and 88 are received beneath hinge stops 53 and 54 respectively and hinge extensions 107, 108 and 109 are received by spaces 101, 102 and 103 respectively. With fin 40 and armbrace 22 thus assembled, hinge pin 45 is pressed through the channel formed by recess 95 through channel 106 and pin slot 88 and through channel 105 through pin slot 98 and thereafter through channel 104 and across the channel formed by recess 94. Hinge pin 45 is sized to fit securely within channels 104, 105 and 106 and pin slots 98 and 84 such that hinge pin 45 is forced against the channels and gripped by recesses 94 and 95 securing hinge pin 45 within the structure and maintaining the assembly. Flatted portion 97 is provided by deforming one end of hinge pin 45 such that it will not readily pass through the channel formed by recess 95.

FIG. 9 shows an alternate embodiment of the present invention forearm swim fin which differs from the above-described structure solely in the shape of the swim fins. Accordingly, the foregoing descriptions apply equally well to the embodiment shown in FIG. 9 with the exception of the shape of the fin portions. A fin 115 defines a generally triangular structure having its base oriented along the hinge 120 and an apex 117. In accordance with an important aspect of the present invention, the triangular shape of fin 115 is a scaline triangular shape whereby apex 117 of triangular shaped fin 115 does not coincide with the center of the fin but is substantially displaced therefrom. A identical fin 116 defines an identical triangular shape having its base oriented along hinge 121 and defining a pointed portion or apex 118 which is aligned with apex 117 of fin 115.

In accordance with an important aspect of the present invention, fins 115 and 116 may be interchanged with each other as shown by the dashed line outlines thereof in FIG. 9. Referring now to the dashed line outlines showing the interchanged positions of fin 115 and fin 116, fin 116 now forms a triangle having its base oriented along hinge 120 and its apex 118 extending outward therefrom. Similarly, in the interchanged position, fin 115 forms a triangular surface having its base oriented along hinge 121 and its apex 117 extending outwardly therefrom. Examination of the difference resulting structure of the forearm swim fin in FIG. 9 by comparing the solid line fin structures to those shown in dashed line representation shows that the interchange of fin members causes a change in the relative position along the swimmer's forearm of apexes 117 and 118. In the first described condition, apexes 117 and 118 are located closer to the swimmer's hand and farther from the swimmer's shoulder. In the interchanged position, apexes 117 and 118 are farther from the swimmer's hand and closer to the swimmer's shoulder. The resulting difference in performance and characteristic of the forearm swim fin caused by interchange of the fin members shown in FIG. 9 is that the effective center of force of the fins is moved with respect to the swimmer's should.

As a result and in in accordance with an important aspect of the present invention, when fins 115 and 116 are assembled such that apexes 117 and 118 are closer to the swimmer's hand, the effective center of force of the swim fins is farther from the swimmer's shoulder providing a greater leverage arm during the power stroke and requiring greater strength on the part of the swimmer. Conversely, when fins 115 and 116 are assembled such that apexes 117 and 118 are farther from the swimmer's hand, a shorter distance is provided between the effective center of force of the fins and the swimmer's should producing a shorter leverage arm during the power stroke and reducing the strength required of the swimmer. As will be apparent to those skilled in the art, the ability to change this strength requirement provides a heretofore unrealized flexibility in the operation of the present invention forearm swim fins.

FIG. 7 sets forth a section view of a portion of the present invention swim fin showing an added advantage of the present invention structure. With reference now to FIGS. 7 and 8 simultaneously, armbrace 22 defines an outwardly extending boss 110 which in turn defines a closed end aperture 111. A pin 120′ is configured to be inserted at one end into aperture 11 and to fit tightly therein such that pin 120′ is maintained securely within aperture 11. The length of pin 120′ is selected to provide an altered characteristic of the present invention forearm swim fin in that pin 120′ extends outwardly from aperture 111 in boss 110 and limits the pivoting motion of fin 40 with respect to armbrace 22. This limit prohibits fin 40 from pivoting from its extended position shown in FIG. 3 to its fully collapsed position shown in FIG. 5. As fin 40 is driven toward the collapsed position, pin end 121 of pin 120′ abutts under surface 86 of fin 40. The point at which pin end 121 abutts under surface 86 is determined by the length of pin 120′. Therefore, the degree of pivoting of fin 40 is controlled by selection of the length of pin 120′. Pin 120′ is used in the present invention forearm swim fin when it is desired to increase the strength requirement imposed upon the swimmer during the return stroke by precluding the normally advantageous pivoting of the fin members to the closed position which normally occurs. In accordance with an important aspect of the present invention, selection of the length of pin 120′ controls the degree of pivoting of fin 40 and thereby the extent of additional stress placed upon the swimmer's return stroke.

What has been shown is an improved forearm swim fin which more precisely controls the surface area configuration provided during the power and return strokes and which provides the increased flexability of interchangeable fin members without the removal of the device from the swimmer's forearm. In addition, the forearm swim fin shown is capable of being configured so as to provide a controlled increase in fin surface area during the return stroke with the purpose of increasing swimmer's strength development.

While particular embodiments of the present invention have shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A swimming aid for use on the forearm of a swimmer carrying out an interleaved series of power and return strokes, said aid comprising:

a pair of substantially planar fin members;

securing means for pivotally securing said pair of fin members on opposed sides of a swimmer's forearm such that said fin members tend to pivot under the influence of the water during the swimmer's forearm motion through the water;

means for limiting the pivotal motion of said fin members to substantially opposed outwardly extending positions during the swimmer's power stroke;

means for limiting the pivotal motion of said fin members during the swimmer's return stroke to substantially parallel rearwardly extending collapsed positions spaced from the swimmer's forearm by a predetermined distance; and means for temporarily locking said fin members in said opposed outwardly extending position during both the power and return strokes of the swimmer.

2. A swimming aid for use on the forearm of a swimmer carrying out an interleaved series of power and return strokes, said aid comprising:

a pair of substantially planar fin members;

securing means for pivotally securing said pair of fin members on opposed sides of a swimmer's forearm such that said fin members tend to pivot under the influence of the water during the swimmer's forearm motion through the water;

means for limiting the pivotal motion of said fin members to substantially opposed outwardly extending positions during the swimmer's power stroke;

means for limiting the pivotal motion of said fin members during the swimmer's return stroke to substantially parallel rearwardly extending collapsed positions spaced from the swimmer's forearm by a predetermined distance;

said fin members defining non-symmetrical surfaces and said securing means including means for interchanging said fin members; and wherein said fin members further define substantially scalene triangular planar surfaces pivotable about their longest side and having respective apexes extending outwardly from the swimmer's forearm and wherein said apexes are repositioned relative to the swimmer's forearm when interchanged to alter the force imposed by the swimmer during the swimmer's stroke action.

3. A swimming aid for use on the forearm of a swimmer carrying out an interleaved series of power and return strokes, said aid comprising:

a pair of substantially planar fin members;

a pair of armbrace members hingedly interconnected to respective fin members, said armbraces formed to be positioned on opposite sides of said forearm;

hinge means interposed between said fin members and said armbrace members, wherein said fin members are formed with a first hinge section along one edge thereof and wherein said armbrace members are formed with a second hinge section and a hinge pin to pivotally connect said first and second hinge sections together;

said hinge means being formed with a means for limiting the pivotal motion of said fin members to substantially opposed outwardly extending positions during the swimmer's power stroke; and wherein said pivotal limiting means includes:

means for altering the collapsed position of said fin members to increase said predetermined distance between the swimmer's forearm and said fin members in a collapsed position;

said altering means being formed in said first hinge section of said fin members as an integral part thereof;

means for adjustably securing said armbraces to the forearm of the swimmer.

4. A swimming aid as set forth in claim 3, wherein said pivotal limiting means further includes means to stop the upward movement of said fin members, said stop means being formed as an integral part of said second hinge section.

5. A swimming aid as set forth in claim 4, wherein said first hinge section comprises a plurality of hinge tabs and wherein said hinge tabs are formed to define said altering means.

6. A swimming aid as set forth in claim 5, wherein said second hinge section comprises an elongated hinge rib member formed as an integral part of said armbrace members, said second hinge section extending outwardly from the outer surface of said armbrace members, and wherein said hinge rib member is formed with a plurality of hinge stop members which are superposed over the respective hinge tabs for engagement therewith as said rib member moves in an upwardly direction to a substantially horizontal plane.

7. A swimming aid as set forth in claim 6, wherein said armbrace members are formed with a concave inner surface and a convex outer surface to conform to the curvature of the forearm portion of a swimmer, a non-slip means being provided on said inner concave surface thereof.

8. A swimming aid as set forth in claim 7, wherein said non-slip means comprises a pad affixed to said concave surface.

9. A swimming aid as set forth in claim 7, wherein said non-slip means comprises a non-slip surface formed on said concave surface.

10. A swimming aid as set forth in claim 3, wherein each of said armbrace members include:

a plurality of elongated slots;

a pair of adjustable fastening straps positioned within said slots whereby said armbrace members are attached to the forearm of the swimmer;

adjustable securing means formed on said straps; and means for securing one end of said strap to said armbrace members.

11. A swimming aid for use on the forearm of a swimmer carrying out an interleaved series of power and return strokes, said aid comprising:

a pair of substantially planar fin members;

a pair of armbrace members hingedly interconnected to respective fin members, said armbraces formed to be positioned on opposite sides of said forearm;

hinge means interposed between said fin members and said armbrace members, wherein said fin members are formed with a first hinge section along one edge thereof and wherein said armbrace members are formed with a second hinge section and a hinge pin to pivotally connect said first and second hinge sections together;

said hinge means being formed with a means for limiting the pivotal motion of said fin members to substantially opposed outwardly extending positions during the swimmer's power stroke;

means for adjustably securing said armbraces to the forearm of the swimmer;

wherein said hinge pin includes means formed at one end of said hinge pin for removably securing said hinge pin therein; and wherein said fin members include a recess formed therein and positioned to receive said hinge pin therein, and wherein said removable securing means of said hinge pin comprises a flat end portion for securing engagement within one of said recesses.

* * * * *